US009283615B2

(12) United States Patent
Kuriyama et al.

(10) Patent No.: US 9,283,615 B2
(45) Date of Patent: Mar. 15, 2016

(54) ENGINE VALVE FORGING SYSTEM

(75) Inventors: Hideto Kuriyama, Hadano (JP); Katsunori Osabe, Hadano (JP); Hiroyuki Akutagawa, Hadano (JP); Kenichi Ikei, Hadano (JP); Hiroaki Takamune, Hadano (JP); Yuki Shimizu, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 0 days.

(21) Appl. No.: 14/369,089

(22) PCT Filed: Dec. 27, 2011

(86) PCT No.: PCT/JP2011/080263

§ 371 (c)(1),
(2), (4) Date: Jun. 26, 2014

(87) PCT Pub. No.: WO2013/098956

PCT Pub. Date: Jul. 4, 2013

(65) Prior Publication Data

US 2014/0345354 A1 Nov. 27, 2014

(51) Int. Cl.

| | |
|---|---|
| ***B21K 1/22*** | (2006.01) |
| ***F01L 3/00*** | (2006.01) |
| ***B21C 23/18*** | (2006.01) |

(52) U.S. Cl.

CPC ..... *B21K 1/22* (2013.01); *B21C 23/183* (2013.01); *F01L 3/00* (2013.01); *F01L 2103/00* (2013.01); *F01L 2103/01* (2013.01)

(58) Field of Classification Search

CPC ..... B21K 1/20; B21K 1/24; B21K 1/22; B21J 9/02; B21J 13/02–13/03; F01L 3/00; F01L 2103/01; F01L 2103/00; B21C 23/183; B21C 25/02

USPC ..... 72/352, 358, 359, 353.2, 354.6, 253.1, 72/467

See application file for complete search history.

(56) References Cited

U.S. PATENT DOCUMENTS 2,138,528 A * 11/1938 Phillipps ..... 72/47
2,278,293 A * 3/1942 Watson ..... 72/316

(Continued)

FOREIGN PATENT DOCUMENTS

JP 60-99446 A 6/1985
JP 02-290641 A 11/1990

(Continued)

OTHER PUBLICATIONS

International Search Report dated Apr. 10, 2012 issued in corresponding application No. PCT/JP2011/080263.

(Continued)

*Primary Examiner* — David Bryant
*Assistant Examiner* — Lawrence Averick
(74) *Attorney, Agent, or Firm* — Westerman, Hattori, Daniels & Adrian, LLP

(57) ABSTRACT

An engine valve forging system includes a molding forging die having a circular hole stem molding portion continued to a tip end of a head type molding portion, to mold an engine valve by extrusion-forging a material from the head type molding portion to the stem molding portion by an upper die, and a stem guide forging die which is coaxially disposed to communicate with a tip end of the stem molding portion, and has a guide portion for a stem portion of an engine valve extruded from the stem molding portion, and a plurality of stem curve restraining portions having a shape gradually tapering toward a central shaft line from a rear end portion to a tip end portion are formed continuously along the central shaft line of the guide portion in the guide portion, to be capable of manufacturing high-precision engine valves with less stem curve.

5 Claims, 4 Drawing Sheets

(56) References Cited

U.S. PATENT DOCUMENTS

| | | | | | |
|---|---|---|---|---|---|
| 2,392,175 | A | * | 1/1946 | Norton | 72/260 |
| 2,411,734 | A | * | 11/1946 | Kerwin et al. | 123/188.1 |
| 2,426,422 | A | * | 8/1947 | Torresen | 470/29 |
| 3,149,415 | A | * | 9/1964 | Hyver | B23K 11/20 228/196 |
| 3,161,285 | A | * | 12/1964 | Hummer et al. | 198/498 |
| 5,007,266 | A | * | 4/1991 | Nishiuchi | B21J 3/00 72/352 |
| 6,035,688 | A | * | 3/2000 | Nagao | B21J 5/02 72/342.3 |
| 7,043,955 | B2 | * | 5/2006 | Nagao et al. | 72/358 |
| 8,881,391 | B2 | * | 11/2014 | Morii et al. | 29/888.45 |

FOREIGN PATENT DOCUMENTS

| | | | | | |
|---|---|---|---|---|---|
| JP | 2000-190046 | A | | 7/2000 | |
| JP | 2002-113542 | A | | 4/2002 | |
| JP | 2004148396 | A | * | 11/2002 | B21K 1/22 |
| JP | 2010-089154 | A | | 4/2010 | |
| JP | 2011-125910 | A | | 6/2011 | |
| JP | WO 2011104916 | A1 | * | 9/2011 | B21C 23/183 |

OTHER PUBLICATIONS

Extended European Search Report dated Mar. 10, 2015, issued in counterpart European Patent Application No. 11878834.8 (7 pages).

English translation of Notification of First Refusal dated Mar. 26, 2015, issued in counterpart Chinese Patent Application No. 201180075409.4 (3 pages).

English translation of Korean Notification of Refusal dated Jul. 10, 2014 (2 pages).

* cited by examiner

ENGINE VALVE FORGING SYSTEM

TECHNICAL FIELD

The present invention relates to a technology of an engine valve forging system which is capable of manufacturing high-precision engine valves with less stem curve of engine valves and the like.

BACKGROUND ART

As a forging die device for manufacturing engine valves by extrusion-forging, there is one shown in the following Patent Document 1. The forging die device in the following Patent Document 1 is to gradually form a stem portion W1 of an engine valve by extrusion-forging of a material W from a molding land 3 provided at the bottom portion of a cavity 2 by utilizing a punch 20. The stem portion W1 is knocked out of the molding land 3, thereby causing a stem curve to right or left from the central shaft line of the stem portion W1 in the tip end of the stem portion W1 as molding progresses. However, because there is an inner diameter greater than an outer diameter of the stem portion W1 in the forging die, and a clearance portion 4 extending in the molding direction of the stem portion W1 is provided therein, the stem portion W1 extends without coming into contact with the inner wall of the forging die even when a stem curve is caused. On the other hand, a knock-out pin 30 which moves forward and backward inside a capture portion 5 is provided in the vicinity of an end position of molding an engine valve, and the tip end of the stem portion W1 comes into contact with a sloping portion 6 to be guided to the capture portion 5 at the last minute of completion of the molding. The molded engine valve whose tip end is pressed by the knock-out pin 30 so as to be held by the capture portion 5, to be taken out of the forging die.

PRIOR ART DOCUMENT

Patent Document

Patent Document 1: Japanese Published Unexamined Patent Application No. 2002-113542

SUMMARY OF THE INVENTION

Problems to be Solved by the Invention

In the forging die device of the prior art document 1, because the stem portion W1 extends without coming into contact with the inner wall of the forging die, the stem curve of the stem portion W1 expands as molding progresses, to be maximized at the tip end of the stem portion W1. In the forging die device in the prior art document 1, the tip end of the stem portion W1 comes into contact with the sloping portion 6 in a short period of time at the last minute of completion of the molding at which the stem curve is maximized, thereby receiving the restraining force for a stem curve by which its travelling direction is directed to the capture portion 5.

However, in an engine valve in which only the tip end of the stem portion W1 is recurved in a large way in a short period of time toward the original central shaft line, the problem that the stem curve of the stem portion W1 is not sufficiently restrained occurs. That is, the forging die device in Patent Document 1 has the problem in the point that engine valves with more stem curve are manufactured.

The present invention has been made in view of the above-described problem, and an object of the present invention is to provide an engine valve forging system which is capable of manufacturing high-precision engine valves with less stem curve of engine valves and the like.

Means for Solving the Problems

An engine valve forging system according to a first aspect includes a molding forging die which has a circular hole shaped stem molding portion which is formed so as to be continued to a tip end of a head type molding portion, and in which an engine valve is molded by extrusion-forging a material from the stem molding portion by an upper die, and a stem guide forging die which communicates with a tip end of the stem molding portion, and is disposed coaxially with the stem molding portion, and which has a guide portion for a stem portion of an engine valve extruded from the stem molding portion, and a stem curve restraining portion which has a shape gradually tapering toward a central shaft line of the guide portion is formed from a rear end portion to a tip end portion (of a stem curve restraining portion which will be described later) in the guide portion.

(Operation) A stem portion of an engine valve molded by the stem molding portion of the molding forging die is guided in the guide portion of the stem guide forging die while causing a stem curve. Because the inner circumference of the guide portion is formed as a sloping surface gradually tapering entirely from the rear end portion to the tip end portion, the stem portion of the engine valve in which a stem curve is caused immediately comes into contact with the guide portion, to receive the force toward the central shaft line, and is restrained from causing a stem curve. The restraining of a stem curve of the stem portion starts immediately after the stem portion is guided to the guide portion, so as to be gradually carried out over a period of time until the completion of molding the stem portion. Accordingly, in the engine valve forging system according to the first aspect, the accuracy of restraining of a stem curve of the stem portion is high.

Further, in accordance with a second aspect, in the engine valve forging system according to the first aspect, a plurality of the stem curve restraining portions are formed continuously along the central shaft line of the guide portion.

(Operation) In the engine valve forging system according to the second aspect, because the plurality of stem curve restraining portions having tapering shapes are repeatedly and continuously formed, the restraining of a stem curve of the stem portion is repeatedly carried out at multiple places other than the tip end of the stem portion. Accordingly, in the engine valve forging system according to the second aspect, the accuracy of restraining of a stem curve of the stem portion is made higher.

Further, in accordance with a third aspect, in the engine valve forging system according to the first aspect or the second aspect, the stem curve restraining portion is formed inside a tubular member, the stem curve restraining portion is further formed into a shape gradually tapering toward a central shaft line of the tubular member from a rear end portion to a tip end portion of the tubular member, and the guide portion is formed to be one circular hole for fixing the tubular member inside so as to be coaxial with the central shaft line of the stem curve restraining portion.

In the engine valve forging system according to the third aspect, the stem curve restraining portion is not formed directly in the guide portion of the stem guide forging die, and the stem curve restraining portion formed into the tubular member as a separate body is integrated with the guide portion later.

(Operation) In the engine valve forging system according to the third aspect, it is possible to replace only a worn stem curve restraining portion, to easily prevent lowering in level of restraining of a stem curve. Further, because the stem curve restraining portion and the guide portion are formed separately, it becomes easy to manufacture the stem curve restraining portion in the guide, and the manufacturing cost is reduced.

Further, in accordance with a fourth aspect, the engine valve forging system according to any one of the first to third aspects, includes a holder in which a forging die fixing hole into which the molding forging die and the stem guide forging die are pressed to be fixed is provided, and the stem molding portion and the guide portion are formed so that the central shaft lines of these (the stem molding portion and the guide portion) are aligned when they are pressed to be fixed into the forging die fixing hole.

(Operation) In the engine valve forging system according to the fourth aspect, it becomes more difficult to cause a stem curve of the stem portion caused by a shift between the central shaft line of the stem molding portion and the central shaft line of the guide portion.

Further, in accordance with a fifth aspect, the engine valve forging system according to any one of the first to fourth aspects, includes a knock-out pin for detaching the engine valve from the molding forging die, which is configured to be capable of moving forward and backward in the stem guide forging die, and is configured to press out a primary molded article as an engine valve composed of an extrusion molded fillet formed site and stem molding site backward, to be capable of holding the primary molded article in a state in which the fillet formed site is separated away from the head type molding portion of the molding forging die.

(Operation) In the engine valve forging system according to the fifth aspect, because it is possible to separate the primary molded engine valve away from the head type molding portion until immediately before secondary molding, a "heat dissipation phenomenon" in which heat of a primary molded article is dissipated via the head type molding portion is prevented. The heat dissipation phenomenon makes a material more difficult to extend in forging, thereby causing unevenness (that is, in the case where measuring instruments are brought into contact with the respective sites of the fillet portion, and the engine valve is rotated around the central shaft line, it does not become a true circle) in the respective sites of the engine valve (the seat portion of the fillet portion (head portion), the bottom portion (the upper surface of the fillet portion), the constricted portion formed at the boundary between the fillet portion and the stem portion, and the like). However, in the engine valve forging system according to the fifth aspect, because the "heat dissipation phenomenon" is suppressed at a minimum, it becomes more difficult to cause unevenness in a molded body as an engine valve.

Further, in accordance with a sixth aspect, the engine valve forging system of the valve gear according to any one of the first to fifth aspects, includes a lower pedestal portion to which the molding forging die and the stem guide forging die are fixed, and an upper pedestal portion which comes close to the lower pedestal portion so as to be parallel to a plane perpendicular to the central shaft line of the stem molding portion, to be pressed against the material on the head type molding portion, and at least two sets or more of pairs of end blocks which respectively have parallel planes facing a plane perpendicular to the central shaft line of the stem molding portion are provided to the lower pedestal portion and the upper pedestal portion, and the upper pedestal portion is formed so that the parallel planes of the end blocks of the upper pedestal portion come into contact with the parallel planes of the end blocks of the lower pedestal portion, thereby stopping coming close to the lower pedestal portion.

(Operation) The upper pedestal portion is stopped to go down to the material on the head type molding portion by the contact between the parallel planes provided to the end blocks of the upper and lower pedestal portions. As a result, in the engine valve forging system according to the sixth aspect, it becomes possible to add equal load on the material of the molding forging die from the upper pedestal portion.

EFFECT OF THE INVENTION

In accordance with the engine valve forging system according to the first aspect, because the accuracy of restraining of a stem curve of the stem portion is higher than the conventional technology, it is possible to obtain a high-quality engine valve with less stem curve.

In accordance with the engine valve forging system according to the second aspect, because the accuracy of restraining of a stem curve of the stem portion is made higher, it is possible to obtain a high-quality engine valve with still less stem curve.

In accordance with the engine valve forging system according to the third aspect, because the accuracy of restraining of a stem curve of the stem portion is not lowered, it is possible to obtain a high-quality engine valve with still less stem curve.

In accordance with the engine valve forging system according to the fourth aspect, because the molding forging die and the stem guide forging die are pressed into the one forging die fixing hole, a shift between the central shaft line of the stem molding portion and the central shaft line of the guide portion can be prevented. Therefore, it is possible to obtain a high-quality engine valve with still less stem curve.

In accordance with the engine valve forging system according to the fifth aspect, because unevenness in the head portion of the engine valve is reduced due to a reduction in a "heat dissipation phenomenon" from the forging die in molding, it is possible to obtain a higher-quality engine valve.

In accordance with the engine valve forging system according to the sixth aspect, because unequal load applied on the material of the molding forging die from the upper pedestal portion is prevented, it is possible to obtain a high-quality engine valve with less stem curve of the engine valve, and with no variation in total lengths of engine valves.

BRIEF DESCRIPTION OF THE DRAWINGS

FIG. 4A is a view showing a primary molded article as an engine valve at the time of putting it into the forging die group for secondary molding. FIG. 4B is a view showing a primary molded article as an engine valve immediately before secondary molding (secondary forging). FIG. 4C is a view showing a secondary molded article as an engine valve after forging. FIG. 4D is a view showing a secondary molded article as an engine valve which is detached from the forging die group for secondary molding.

BEST MODES FOR CARRYING OUT THE INVENTION

Next, an embodiment relating to an engine valve forging system will be described by FIGS. 1 to 4. In addition, in the following description, the vertical direction along a central shaft line L0 of a molding forging die and a stem guide forging die in the respective diagrams will be described as the upper side:the lower side=Up:Lw, and the horizontal direction perpendicular to the central shaft line L0 on the respective diagrams will be described as the left side:the right side=Le:Ri.

Figure 1:
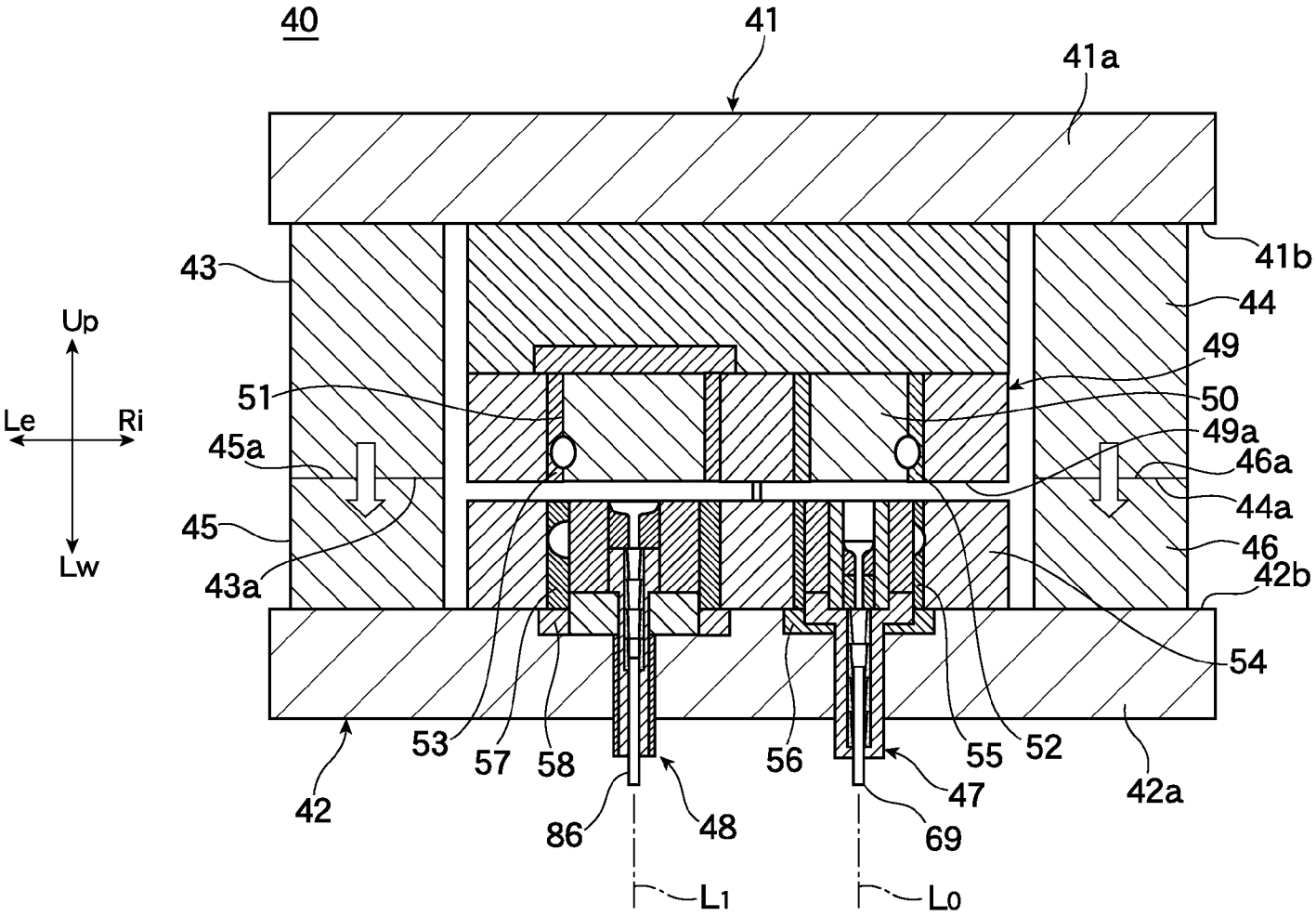
FIG. 1 is a cross-sectional view showing an embodiment of an engine valve forging system.

An engine valve forging system 40 of a first embodiment shown in FIG. 1 is composed of an upper pedestal portion 41, a lower pedestal portion 42, end blocks (43 to 46), a forging die group for primary molding 47, and a forging die group for secondary molding 48.

The upper pedestal portion 41 is composed of a pressing portion 49 integrated in the vicinity of the center of a lower surface 41*b* of an upper panel portion 41*a*, and the upper side end blocks (43 and 44), and upper dies (50 and 51) are respectively fixed to positions corresponding to the forging die group for primary molding 47 and the forging die group for secondary molding 48 with rings (52 and 53) at a lower surface 49*a* of the pressing portion 49.

The lower pedestal portion 42 is composed of a fixation pedestal 54 integrated in the vicinity of the center of an upper surface 42*b* of a lower panel portion 42*a*, and the lower side end blocks (45 and 46). On the fixation pedestal 54, the forging die group for primary molding 47 is fixed to a position corresponding to an upper die 50 via a ring 55 and a lower plate 56, and the forging die group for secondary molding 48 is fixed to a position corresponding to the upper die 51 via a ring 57 and a lower plate 58.

As shown in FIG. 1, the upper and lower end blocks (43 and 45) and (44 and 46) are respectively paired. Further, the upper end blocks (43 and 44) and the lower end blocks (45 and 46) respectively have parallel planes (43*a* to 46*a*) perpendicular to both of the central shaft line L0 of a molding forging die 59 and a central shaft line L1 of a molding forging die 80 which will be described later. Because the upper pedestal portion 41 is formed so that the parallel planes (43*a* and 44*a*) of the end blocks (43 and 44) of the upper pedestal portion 41 come into contact with the parallel planes (45*a* and 46*a*) of the end blocks (45 and 46) of the lower pedestal portion 42, thereby stopping coming close to the lower pedestal portion 42, the upper dies (50 and 51) equally put load on a metallic material 95 or a primary molded article 96 on a head type molding portion (72, 91) in FIGS. 2 and 3 which will be described later. In addition, two sets or more of the upper and lower end blocks may be installed.

Figure 2:
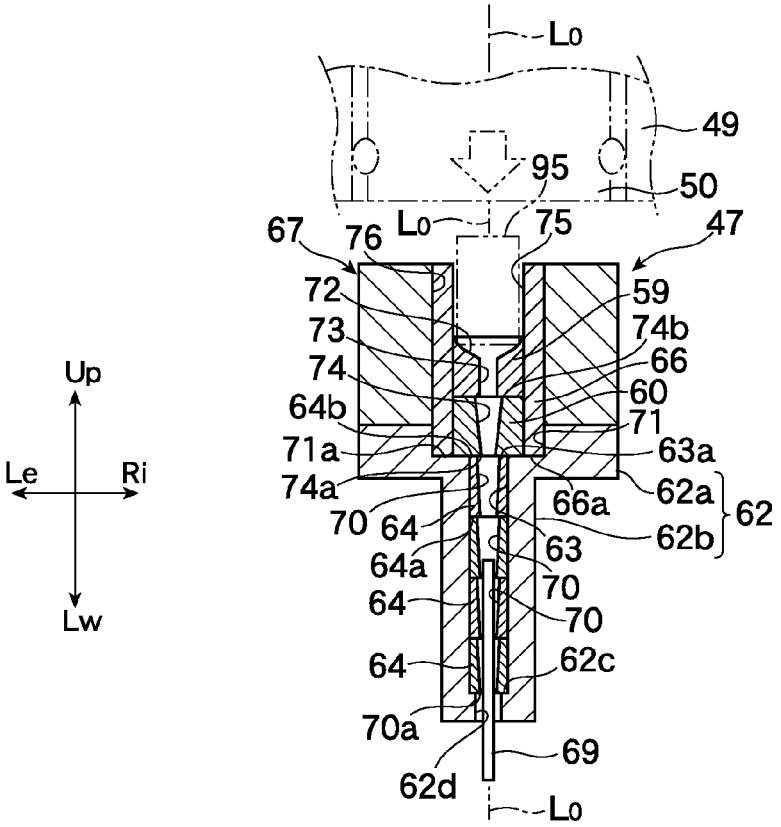
FIG. 2 is an enlarged cross-sectional view showing a forging die group for primary molding of the engine valve forging system.

The forging die group for primary molding 47 shown in FIG. 2 is composed of the molding forging die 59, a first stem guide forging die 60, a second stem guide forging die 62, a plurality of cylindrically-shaped tubular members 64 having stem curve restraining portions 70 for restraining a stem curve from being caused, a forging die fixing ring 66, a holder 67, and a knock-out pin 69.

The second stem guide forging die 62 is formed from a flange portion 62*a* and a cylindrical portion 62*b*. A concentric hole shaped guide portion 63 having an inner diameter which is substantially the same as an outer diameter of the tubular members 64 is formed around the central shaft line L0 in the second stem guide forging die 62, and the respective tubular members 64 have the stem curve restraining portions 70 inside thereof, and are inserted to be fixed to the guide portion 63, thereby being fixed to the guide portion 63. Further, the stem curve restraining portions 70 of the respective tubular members 64 are respectively composed of circular truncated cone holes gradually tapering toward their tip end sides (in the Lw direction in FIG. 2) and the central shaft line L0. The respective tubular members 64 are inserted into the guide portion 63, to be disposed coaxially with the guide portion 63 (the central shaft line L0). The stem curve restraining portions 70 are formed over the entire area from a rear end portion 64*b* to a tip end portion 64*a* of the tubular members 64.

In addition, a circular hole shaped ring fixing hole 71 which communicates with the rear end portion of the guide portion 63 and opens in the rear is provided in the flange portion 62*a*. The ring fixing hole 71 is formed so as to communicate with the guide portion 63 coaxially (the central shaft line L0) with the guide portion 63, and has an inner diameter which is smaller by a minute length than the outer diameter of the forging die fixing ring 66. Further, a level difference portion 62*c* is provided in the vicinity of the tip end portion of the cylindrical portion 62*b*. The level difference portion 62*c* is formed so that the tubular member 64 inserted on the front tip end portion side among the plurality of tubular members 64 is held by the level difference portion 62*c*, thereby holding the rear end portion 64*b* of the tubular member 64 inserted on the back rear end portion side so as to be flush with a rear end opening portion 63*a* of the guide portion 63. Further, a circular hole 62*d* communicating with tip end opening portions 70*a* of the stem curve restraining portions 70 is provided on the tip end side of the level difference portion 62*c*, and the knock-out pin 69 is inserted into the circular hole 62*d* and the stem curve restraining portions 70 from their tip end sides (the symbol Lw side).

On the other hand, the molding forging die 59 and the first stem guide forging die 60 are formed into substantially cylindrical shapes whose outer diameters are the same. The molding forging die 59 has a head type molding portion 72 formed of a downward head type concave portion shape with the L0 being a central shaft line, and is further formed continuously and integrally with the tip end of the head type molding portion 72, and has a circular hole shaped stem molding portion 73 which is formed coaxially (the central shaft line L0) with the head type molding portion 72. The first stem guide forging die 60 has a stem curve restraining portion 74 formed around the central shaft line L0 in the same shape of the stem curve restraining portions 70 in the tubular members 64. The rear end opening portion 74*b* of the stem curve restraining portion 74 is formed so as to have an inner diameter greater than the inner diameter of the stem molding portion 73, which makes it easy to guide the stem portion of a molded engine valve.

Further, the circular hole inside the forging die fixing ring 66 is formed as a forging die fixing hole 75, and an inner diameter of the forging die fixing hole 75 is formed to be smaller by a minute length than an outer diameter of the molding forging die 59 and the first stem guide forging die 60. The molding forging die 59 and the first stem guide forging die 60 are pressed into the forging die fixing hole 75, thereby being fixed. As a result, the stem molding portion 73 and the stem curve restraining portion 74 are fixed coaxially (the central shaft line L0).

On the other hand, a cylindrically-shaped holder 67 having the same outer diameter as the flange portion 62*a* is disposed so as to be adjacent on an upper surface 62*e* of the flange portion 62*a* of the second stem guide forging die 62. A circular hole 76 inside the holder 67 is formed to be smaller by a minute length than the outer diameter of the forging die fixing ring 66.

The second stem guide forging die 62 and the holder 67 into which the plurality of tubular members 64 are inserted are integrated by pressuring a tip end 66*a* of the forging die fixing ring 66 from the circular hole 76 up to a lower portion 71*a* of the ring fixing hole 71 as shown in FIG. 2. Further, the molding forging die 59 and the first stem guide forging die 60 are pressed into the forging die fixing hole 75 of the forging die fixing ring 66, thereby being integrated with the second stem guide forging die 62. At that time, because the forging die fixing hole 75 of the forging die fixing ring 66 is disposed coaxially (the central shaft line L0) with respect to the guide portion 63 of the second stem guide forging die 62, the respective central lines of the stem molding portion 73 of the molding forging die 59, the stem curve restraining portion 74 of the first stem guide forging die 60, and the respective stem curve restraining portions 70 of the plurality of tubular members 64 are all disposed coaxially (the central shaft line L0). Because the stem molding portion 73, the stem curve restraining portion 74, and the plurality of stem curve restraining portions 70 are precisely disposed coaxially (the central shaft line L0), the stem portion of an engine valve to be molded is precisely restrained in its stem curve by the stem curve restraining portion 74 and the plurality of stem curve restraining portions 70.

Figure 3:
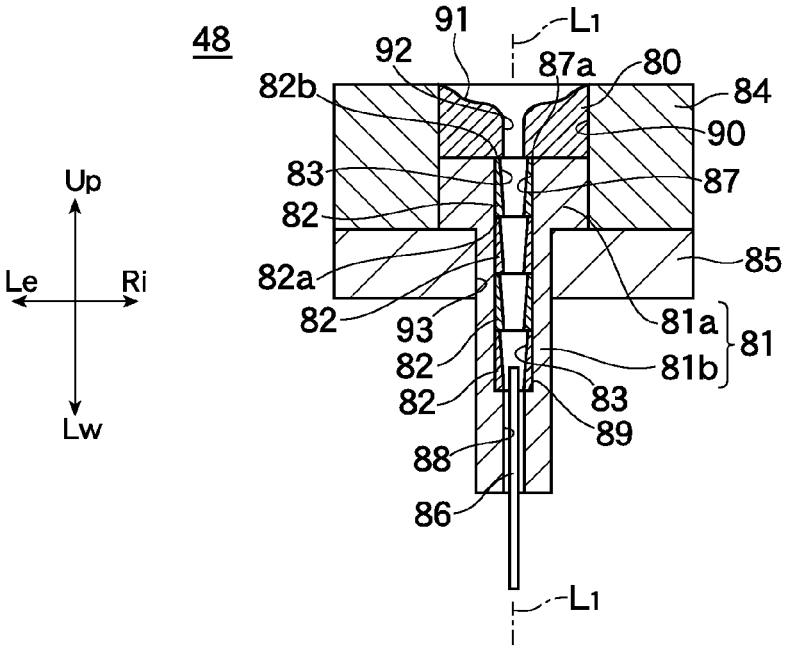
FIG. 3 is an enlarged cross-sectional view showing a forging die group for secondary molding of the engine valve forging system.

On the other hand, the forging die group for secondary molding 48 shown in FIG. 3 is composed of a molding forging die 80, a stem guide forging die 81, a plurality of cylindrically-shaped tubular members 82 having stem curve restraining portions 83 for restraining a stem curve from being caused, a first holder 84, a second holder 85, and a knock-out pin 86.

The stem guide forging die 81 is formed from a flange portion 81*a* and a cylindrical portion 81*b*. A concentric hole shaped guide portion 87 having an inner diameter which is substantially the same as an outer diameter of the tubular member 82, and a circular hole 88 which has a diameter smaller than that of the guide portion 87, and communicates with a tip end of the guide portion 87 are formed around the central shaft line L1 in the stem guide forging die 81. The respective tubular members 82 have stem curve restraining portions 83 inside thereof, and are inserted into the guide portion 87. The stem curve restraining portions 83 of the respective tubular members 82 are respectively composed of circular truncated cone holes gradually tapering toward their tip end sides (in the Lw direction in FIG. 3) and the central shaft line L1, thereby being disposed coaxially (the central shaft line L1) with the guide portion 87. The stem curve restraining portions 83 are formed over the entire area from rear end portions 82*b* to tip end portions 82*a* of the respective tubular members 82.

A level difference portion 89 which is formed at the boundary between the guide portion 87 and the circular hole 88 is formed so that the tubular member 82 inserted on the front tip end portion side among the plurality of tubular members 82 is held by the level difference portion 89, thereby holding the rear end portion 82*b* of the tubular member 82 inserted on the back rear end portion side so as to be flush with a rear end opening portion 87*a* of the guide portion 87. A knock-out pin 86 is inserted into the circular hole 88 and the stem curve restraining portions 83 from their tip end sides (the symbol Lw side).

Further, the molding forging die 80 has a head type molding portion 91 formed from a downward head type concave portion shape with the L1 being a central shaft line, and is further formed continuously and integrally with the tip end of the head type molding portion 91, and has a circular hole shaped stem molding portion 92 which is formed coaxially (the central shaft line L1) with the head type molding portion 91. The molding forging die 80 and the flange portion 81*a* of the stem guide forging die 81 are formed into substantially cylindrical shapes having the same outer diameter, and the first and second holders (84 and 85) are both formed into cylindrical shapes, and are formed to have the same outer diameter. An inner diameter of a circular hole 90 inside the first holder 84 is formed to be smaller by a minute length than the outer diameter of the molding forging die 80 and the flange portion 81*a*, and an inner diameter of a circular hole 93 inside the second holder 85 is formed to have a diameter slightly greater than the outer diameter of the cylindrical portion 81*b* of the stem guide forging die 81.

The molding forging die 80 and the stem guide forging die 81 are pressed into the circular hole 90, thereby being fixed to the first holder 84. As a result, the stem molding portion 92 and the plurality of stem curve restraining portions 83 are all disposed coaxially (the central shaft line L1). Because the stem molding portion 92 and the plurality of stem curve restraining portions 83 are precisely disposed coaxially (the central shaft line L1), the stem portion of an engine valve to be molded is precisely restrained in its stem curve by the stem curve restraining portions 83.

Next, a series of engine valve molding processes will be described by FIGS. 1 to 4. A metallic material for engine valve molding is forge-processed into a primary molded article by the forging die group for primary molding 47, and is thereafter secondary-molded into an engine valve by the forging die group for secondary molding 48.

In the material primary molding process, first, as shown in FIG. 2, the metallic material 95 is disposed on the head type molding portion 72 of the molding forging die 59, and the upper pedestal portion 41 at the upper side is moved down in the Lw direction. When the upper pedestal portion 41 moves down, the upper die 50 of the pressing portion 49 is pressed against the metallic material 95 on the head type molding portion 72, and a part of the metallic material 95 on the head type molding portion 72 is pushed out to the stem molding portion 73. The part of the metallic material 95 pushed out to the stem molding portion 73 is molded into a stem portion formed site 96*a*, and is molded into a primary molded article (refer to a symbol 96 in FIG. 4) along with an a head portion (a fillet portion) formed site 96*b* which is the remaining portion of the metallic material 95 left on the head type molding portion 72.

The tip end of the stem portion formed site which is not shown in FIG. 2 intrudes into the stem curve restraining portion 74 of the first stem guide forging die 60 while causing a stem curve by extrusion-forging molding, to immediately come into contact with the sloping surface tapering in the travelling direction of the stem portion formed site toward the central shaft line L0. The tip end of the stem portion formed site in contact with the sloping surface is gradually restrained in its stem curve as it moves toward the tip end opening portion 74*a* of the stem curve restraining portion 74, and thereafter intrudes into the stem curve restraining portions 70.

In the case where restraining of a stem curve by the stem curve restraining portion 74 is insufficient, the tip end of the stem portion formed site comes into contact with the sloping surfaces of the stem curve restraining portions 70 which are continuously disposed in plural, thereby being repeatedly restrained in its stem curve. As a result, the stem portion formed site is greatly reduced in its stem curve. The molded primary molded article 96 is taken out of the forging die group for primary molding 47 by knocking up the tip end of the stem portion formed site upward (in the direction of the symbol Up) by the knock-out pin 69, to be placed on the forging die group for secondary molding 48.

Figure 4:
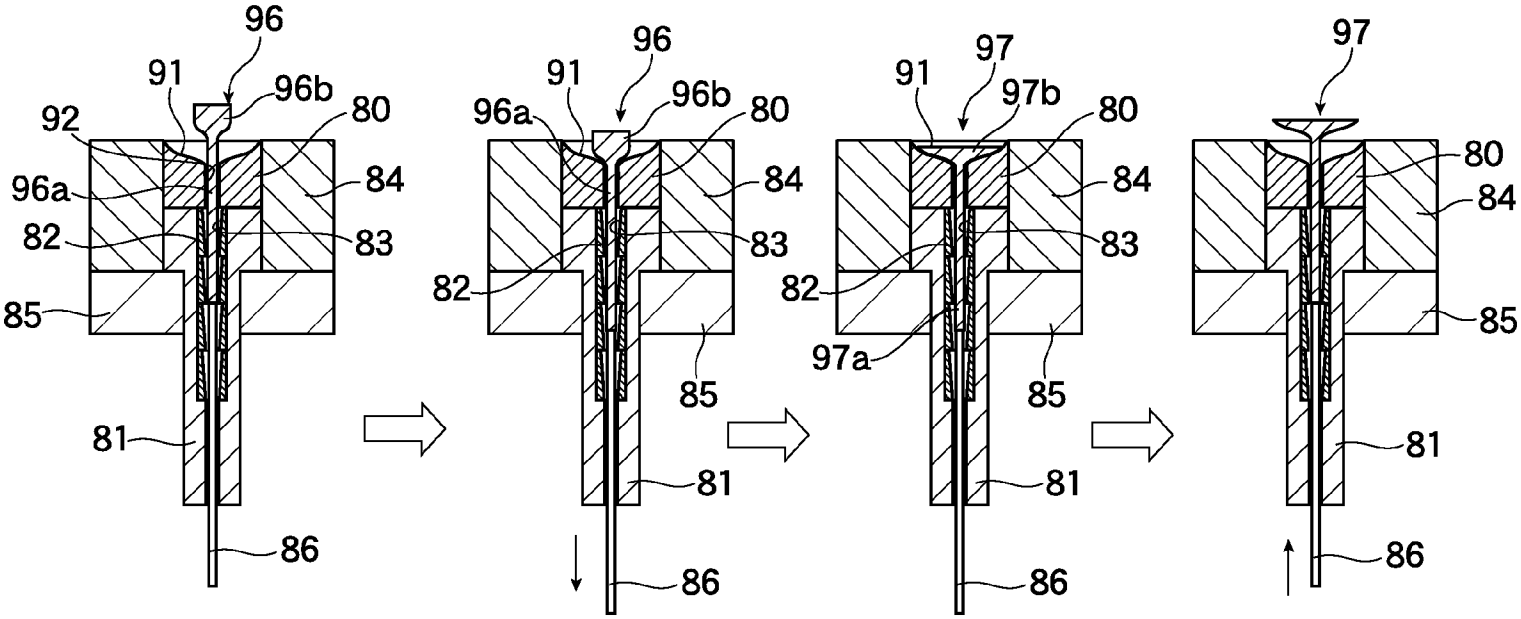
FIG. 4 are cross-sectional views sequentially showing a heat dissipation phenomenon preventing structure by the engine valve forging system.

FIG. 4 show a secondary molding process of the primary molded article 96 by the forging die group for secondary molding 48. In FIG. 4, the molding process proceeds from the left diagram to the right diagram. The stem portion formed site 96*a* of the primary molded article 96 before secondary molding is, as shown in the first diagram from the left in FIG. 4, is put into the stem curve restraining portions 83 of the stem guide forging die 81 from the stem molding portion 92 of the molding forging die 80. At that time, the knock-out pin 86 is moved up to a proper height, and the head portion formed site 96*b* is held so as to be separated upward from the head type molding portion 91 when the tip end of the stem portion formed site 96*a* comes into contact with the knock-out pin 86. By separating the head portion formed site 96*b* away from the head type molding portion 91 until the time immediately before secondary molding, it becomes more difficult to cause a heat dissipation phenomenon in the head portion formed site 96*b*. As a result, it becomes more difficult to cause unevenness in a shape of an engine valve after secondary molding.

In the secondary molding process, as shown in the second diagram from the left in FIG. 4, the knock-out pin 86 is moved down until the head portion formed site 96*b* comes into contact with the head type molding portion 91 immediately before starting the secondary molding process, and the upper pedestal portion 41 at the upper side is moved down in the Lw direction as shown in FIG. 1. When the upper pedestal portion 41 moves down, the upper die 51 of the pressing portion 49 is pressed against the head portion formed site 96*b* of the primary molded article 96 on the head type molding portion 91. As a result, the head portion formed site 96*b* on the head type molding portion 91 is molded into a head portion (a fillet portion) 97*a* shown in the third diagram from the left in FIG. 4. On the other hand, the stem portion formed site 96*a* of the primary molded article 96 moves down in the plurality of stem curve restraining portions 83 in the stem guide forging die 81 as the molding of the head portion formed site 96*b* progresses, thereby restraining a stem curve caused during the secondary molding process, to be molded into a stem portion 97*b*. As a result, the completed engine valve is reduced greatly in a stem curve of the stem portion. A molded engine valve 97 is taken out of the forging die group for secondary molding 48 by knocking up the tip end of the stem portion 97*a* upward (in the direction of the symbol Up) by the knock-out pin 69.

Figure 5:
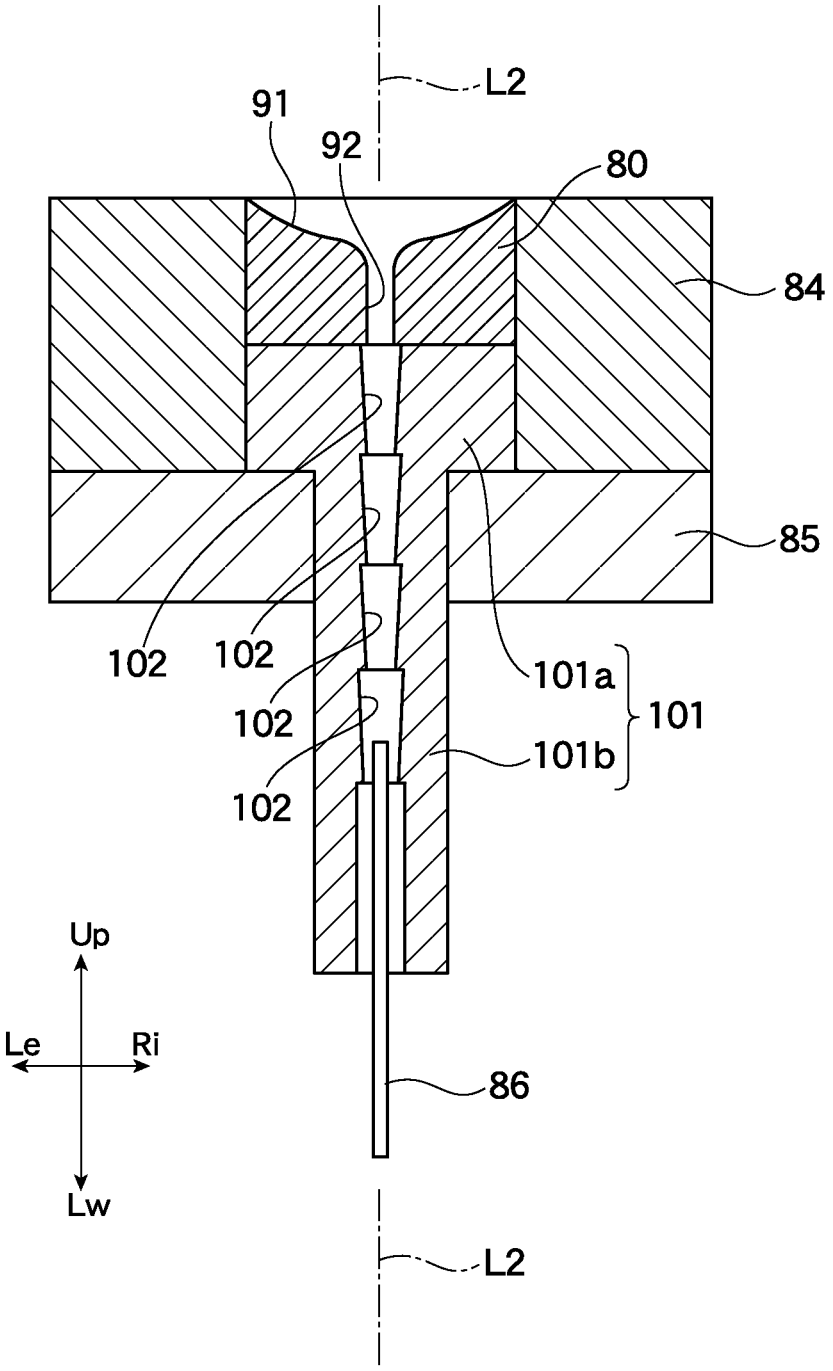
FIG. 5 shows a modified example of a stem curve restraining portion, and an enlarged cross-sectional view showing the stem curve restraining portion being formed directly in the stem guide forging die.

In addition, FIG. 5 shows a modified example of the stem guide forging die 81 of FIG. 3, and the other configurations show a modified example as the stem curve restraining portions 83, and are in common with the forging die group for secondary molding 48. In FIG. 5, a plurality of stem curve restraining portions 102 which are composed of circular truncated cone holes gradually tapering toward their tip end sides (in the Lw direction in FIG. 2) and a central shaft line L2 are repeatedly formed around the central shaft line L2 of a stem guide forging die 101 formed from a flange portion 101*a* and a cylindrical portion 101*b*. In addition, in the stem guide forging die 101, the stem curve restraining portions 102 are integrally formed. Meanwhile, in view of replacement in response to wearing of those, stem curve restraining portions are preferably formed as separate members into tubular members (64 and 82) as in FIGS. 2 and 3, so as to be detachable.

EXPLANATION OF SYMBOLS

40 Engine valve forging system
41 Upper pedestal portion
42 Lower pedestal portion
43 to 46 End blocks
43*a* to 46*a* Parallel planes
50, 51 Upper die
59, 80 Molding forging die
60 First stem guide forging die
62 Second stem guide forging die
63, 87 Guide portion
64, 82 Tubular member
64*a*, 82*a* Tip end portion of tubular member (stem curve restraining portion)
64*b*, 82*b* Rear end portion of tubular member (stem curve restraining portion)
66 Forging die fixing ring (holder)
67 Holder
69, 86 Knock-out pin
70, 74, 83 Stem curve restraining portions
72, 91 Head type molding portion
73, 92 Stem molding portion
81 Stem guide forging die
84 First holder
95 Material
96 Primary molded article (material)
97 Engine valve
97*a* Stem portion
L0, L1, L2 Central shaft line

The invention claimed is:

1. An engine valve forging system, comprising:

a molding forging die for an engine valve, the molding forging die having a circular hole shaped stem molding portion which is contiguous with a tip end of a head type molding portion and adapted to extrusion-forge a material on the head type molding portion to the stem molding portion by an upper die; and at least one stem guide forging die which is disposed coaxially with the stem molding portion, and which has a plurality of stem curve restraining portions, separated from the stem molding portion, for forming a stem portion of an engine valve extruded from the stem molding portion, wherein each stem curve restraining portion is tapered gradually toward a central shaft line of the stem curve restraining portion over the entire area thereof from its rear end portion to its tip end portion, such that the stem curve restraining portion has a rear end opening portion whose inner diameter is greater than that of a tip end opening portion of the stem molding portion;

wherein the tip end of the stem molding portion is communicated with a rear end opening of one stem curve restraining portion;

wherein said plurality of stem curve restraining portions are arranged in a linear array along their central shaft line; and wherein the tip end of each stem curve restraining portion is communicated with a rear end opening portion of another stem curve restraining portion having a larger inner diameter than the tip end of the respective stem curve restraining portion.

2. The engine valve forging system according to claim 1, wherein the stem curve restraining portion is formed inside a tubular member, wherein the stem curve restraining portion is further formed into a shape gradually tapering toward a central shaft line of the tubular member from a rear end portion to a tip end portion of the tubular member, and wherein a guide portion is one circular hole for fixing the tubular member inside so as to be coaxial with the central shaft line of the stem curve restraining portion.

3. The engine valve forging system according to claim 1, further comprising a holder in which a forging die fixing hole into which the molding forging die and the stem guide forging die are pressed to be fixed is provided, wherein the stem molding portion and the stem curve restraining portion are formed so that the central shaft lines of these are aligned when they are pressed to be fixed into the forging die fixing hole.

4. The engine valve forging system according to claim 1, further comprising a knock-out pin for detaching the engine valve from the molding forging die, which is configured to be capable of moving forward and backward in the stem guide forging die, and is configured to press out a primary molded article as an engine valve composed of molded fillet formed site and stem molding site backward, to be capable of holding the primary molded article in a state in which the fillet formed site is separated away from the head type molding portion of the molding forging die.

5. The engine valve forging system according to claim 1, further comprising:

a lower pedestal portion to which the molding forging die and the stem guide forging die are fixed; and an upper pedestal portion which comes close to the lower pedestal portion so as to be parallel to a plane perpendicular to the central shaft line of the stem molding portion, to be pressed against the material on the head type molding portion, wherein at least two sets or more of pairs of end blocks which respectively have parallel planes facing a plane perpendicular to the central shaft line of the stem molding portion are provided to the lower pedestal portion and the upper pedestal portion, and wherein the upper pedestal portion is formed so that the parallel planes of the end blocks of the upper pedestal portion come into contact with the parallel planes of the end blocks of the lower pedestal portion, thereby stopping coming close to the lower pedestal portion.

* * * * *